US005131615A

United States Patent [19]

Hosan et al.

[11] Patent Number: 5,131,615

[45] Date of Patent: Jul. 21, 1992

[54] SUPPORT COLUMN

[75] Inventors: Hans-Josef Hosan, Neuwied; Axel Knopp, Eitelborn, both of Fed. Rep. of Germany

[73] Assignee: Stabilus GmbH, Koblenz-Neuendorf, Fed. Rep. of Germany

[21] Appl. No.: 644,545

[22] Filed: Jan. 23, 1991

[30] Foreign Application Priority Data

Feb. 3, 1990 [DE] Fed. Rep. of Germany ..... 4003245

[51] Int. Cl.[5] ..... F16F 9/00

[52] U.S. Cl. ..... 248/161; 248/622; 384/32

[58] Field of Search ..... 248/161, 162.1, 188.5, 248/404, 405, 406.1, 406.2, 410, 411, 412, 413, 414, 623, 600, 601, 599, 631; 297/345, 338; 384/32, 202, 26, 29, 37, 38, 42, 192, 203, 208; 267/131, 132, 120, 64.12

[56] References Cited

U.S. PATENT DOCUMENTS

| | | | |
|---|---|---|---|
| 3,683,754 | 8/1972 | Stuyvenberg | 384/202 X |
| 3,828,651 | 8/1974 | Dorner et al. | 248/631 X |
| 4,093,196 | 6/1978 | Bauer | 248/622 X |
| 4,244,627 | 1/1981 | Hastings, Jr. | 384/32 |
| 4,257,582 | 3/1981 | Wirges | 297/345 X |
| 4,848,524 | 7/1989 | Hosan et al. | 384/32 X |
| 4,946,143 | 8/1990 | Bauer et al. | 267/120 X |
| 4,949,941 | 8/1990 | Bauer et al. | 267/64.12 |
| 5,079,992 | 1/1992 | Bauer et al. | 267/131 |

FOREIGN PATENT DOCUMENTS

| | | | |
|---|---|---|---|
| 0325726 | 2/1989 | European Pat. Off. . | |
| 2291406 | 6/1976 | France | 384/37 |

*Primary Examiner*—Karen J. Chotkowski

*Attorney, Agent, or Firm*—Brumbaugh, Graves, Donohue & Raymond

[57] ABSTRACT

A chair column comprises a stand tube. A support bush is inserted into the upper end portion of the stand tube. A gas spring cylinder extends axially through the receiver bush. The piston rod is directed downward and is connected with a bottom of the stand tube. The gas spring cylinder is guided through two axially spaced bearing bushes. The bearing bushes are radially supported by the receiver bush through a radially prestressed transmission ring or a plurality of circumferentially distributed buffers. The radial prestress is transmitted to the contact face between the bearing bushes and the gas spring cylinder.

26 Claims, 4 Drawing Sheets

SUPPORT COLUMN

BACKGROUND OF THE INVENTION

Support columns are used for height adjustable chairs and tables. Such a support column comprises a foot structure and a stand tube. A gas spring is received by the stand tube. The cylinder of the gas spring is guided within an upper end portion of the stand tube, and the lower end of the piston rod is connected to the bottom of the stand tube. A seat plate is connected to the upper end of the cylinder of the gas spring. The cylinder of the gas spring is slidingly guided in a guide unit inserted into the upper end portion of the stand tube.

STATEMENT OF THE PRIOR ART

From German publication 36 27 138 corresponding to U.S. Pat. No. 4,848,524 a support column is known with a guide unit consisting of a receiver tube and ball bearing members received in spherical grooves at the inner surface of the receiver bush. The cylinder of the gas spring is slidingly guided within axial bores of the ball bearing members. While this known construction has been successfully used in practice, it has been found that the ball bearing members and the receiver bush must be manufactured with a very high degree of precision in order to avoid an undesirable radial play of the respective gas spring cylinder with respect to the stand tube. If a lower degree of precision is applied, a radial play exists between the stand tube and the cylinder of the gas spring which is unpleasant in case of chair constructions for the user of the chair and also tends to noise generation.

OBJECT OF THE INVENTION

It is a primary object of the present invention to provide a support column, in which a radial play between the stand tube and a telescopic positioning device accommodated therein is avoided.

A further object of the invention is to provide a less complicated construction at low cost.

SUMMARY OF THE INVENTION

A support column comprises a stand tube having an axis, a bottom part and an upper end portion. A receiver bush is inserted into the upper end portion. A telescopic positioning device has a lower terminal portion connected to the bottom part of the stand tube and a cylindrical member extending through the receiver bush. The cylindrical member has an outer cylindrical surface guided within said receiver bush in substantially axial direction with respect to the stand tube.

The outer cylindrical surface is in sliding engagement with at least one bearing bush. This bearing bush is radially supported by the receiver bush. The bearing bush is radially supported by the receiver bush through radially elastic transmission means. These radially elastic transmission means are radially prestressed. The bearing bush is radially prestressed against the outer cylindrical surface by the radial prestress of the transmission means.

Thus a play-free mounting is achieved between the telescopic positioning device and the stand tube. The telescopic positioning device may be a pneumatic spring of usual design. The gas spring may comprise one or two or even three coaxial cylindrical tubes. The respective outermost cylindrioal tube provides the outer cylindrical surface guided within the respective receiver bush.

The bearing bush may be completely transversed by a substantially axially and radially extending slot. Due to this slot, the bearing bush adapts itself smoothingly to the outer cylindrical surface of the cylindrical member of the telescopic positioning device. The prestress of the transmission means is fully transmitted to the outer cylindrical surface. It is to be noted, however, that this slot can be easily avoided, if the bearing bush is made of a relatively thin and elastic material. In this case, the bearing bush may be circumferentially compressed, even if no slot is provided, such that again the prestress of the transmission means is transmitted to the outer cylindrical surface of the cylindrical member.

According a a first embodiment of the invention, the radially elastic transmission means may comprise a radially elastic transmission ring. This radially elastic transmission ring may be coherent with said bearing bush, e. g. by adhesive or by shape-locking engagement or by two-layer injection-moulding.

The radially elastic transmission ring may be at least partially received by a corresponding annular recess provided at a radially inner surface of the receiver bush. The respective bearing bush may also be partially received by the annular recess so that both the elastic transmission ring and the bearing bush are positively secured in axial direction with respect to the receiver bush.

The radially elastic transmission ring may have a convex radially outer surface supported by a respective radially inner concave surface of the receiver bush. This embodiment has the advantage of easy manufacturing.

According to another embodiment, the radially elastic transmission means may comprise a plurality of elastic buffer members distributed around the axis. Preferably, at least three elastic buffers are provided. These buffer members may be at least partially received by respective cavities within the receiver bush. The buffer members may be adherent to the receiver bush. E. g., one can provide buffer members with a pressure-sensitive adhesive on the respective surface to be accommodated within the cavities. Further, it is possible to provide the buffer members within the cavities by injection-moulding.

The receiver bush may be subdivided into a plurality of receiver bush segments, e. g. two or three segments. By separating the receiver bush into segments, the assembling of the receiver bush with the elastic transmission means and the bearing bush is facilitated. The receiver bush segments may be connected to each other by segment connection means, e. g. press button type connection means. These connection means facilitate the assembling.

For saving material, the receiver bush may be provided with a plurality of recesses in a radially outer surface thereof.

The elastic transmission means may be made of an elastomeric material substantially softer in radial direction than the material of the receiver bush. E. g., the radially elastic transmission means may be made of a rubber elastic material or a foam plastic material. The receiver bush may be made of a synthetic plastic material, such as nylon.

Also the bearing bush may be made of a synthetic plastic material, which has a low coefficient of friction. E. g., the bearing bush may be made of a graphite containing plastic material. The plastic material used for manufacturing the bearing bush may be a material on a polyamide basis or PTFE basis.

The use of a plastic made bearing bush is particularly desirable, if a non-slotted bush is used.

Alternatively, the bearing bush may also be made of a metal sheet material coated with a bearing surface layer. This embodiment is particularly applicable, if the bearing bush is slotted.

A plurality of bearing bushes may be provided along the axis. Preferably, two such bearing bushes are provided. In the case of two or more bearing bushes, axial misalignment may be compensated for by the elasticity of the respective elastic transmission means. It is, however, not excluded that a ball bearing member is provided for at least one of the bearing bushes as described in U.S. Pat. No. 4,848,524 (German Publication 36 27 138). Such a ball bearing member may be combined with the elastic transmission means of this invention.

In case of a plurality of bearing bushes, each of the bearing bushes may be combined with separate radially elastic transmission means allocated thereto.

The lower terminal portion of the telescopic positioning device may have a radial play with respect to the bottom part of the stand tube. This is also a possibility of compensating for axial misalignment.

The telescopic positioning device is preferably a cylinder-piston rod device having at least one cylinder member and a piston rod. In this case, the piston rod may be connected to the bottom part of the stand tube, and the cylinder member provides in this case the outer cylindrical surface. More particularly, the cylinderpiston rod device may be a pneumatic spring.

The stand tube may be adapted for being connected with a foot structure, and the cylindrical member may be adapted for being connected with a load member, such as a seat plate or a table plate.

The present invention further relates to a method of assembling a support column as defined above. This method may comprise the providing of a preassembled guide unit consisting of the receiver bush, the radially elastic transmission means and the bearing bush. This preassembled guide unit is inserted into the upper end portion of the stand tube. Thereafter, the telescopic positioning device is inserted into the stand tube through the preassembled guide unit. The bearing bush should have an internal diameter equal to or smaller than the outer diameter of the outer cylindrical surface before inserting the telescopic positioning device into the stand tube. The radially elastic transmission means are then radially prestressed by inserting the outer cylindrical surface of the cylindrical member through the bearing bush. The cylindrical member may be provided, when applying the above method, with at least one tapered spreading surface for expanding the bearing bush, when the cylindrical member is axially inserted through the preassembled guide unit.

An alternative method comprises preassembling the receiver bush, the radially elastic transmission means and the bearing bush around the outer cylindrical surface of the cylindrical member. In this case, the receiver bush provides an external diameter equal or somewhat larger than the internal diameter of the upper end portion of the stand tube. The telescopic positioning device is then inserted together with the receiver bush, the elastic transmission means and the bearing bush into the stand tube, while radially compressing the receiver bush before or during being inserted into the upper end portion of the stand tube against the elastic resistance of the elastic transmission means.

In this latter method, at least one of the stand tube and the receiver bush may be provided with a tapered face for radially compressing the receiver bush when being inserted into the upper end portion of the stand tube.

The various features of novelty which characterize the invention are pointed out with particularity in the claims annexed hereto and forming a part of the disclosure. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWINGS

The invention will be explained in greater detail hereinafter by reference to the forms of embodiment illustrated in the drawing, wherein.

DESCRIPTION OF THE PREFERRED EMBODIMENTS

Figure 1:
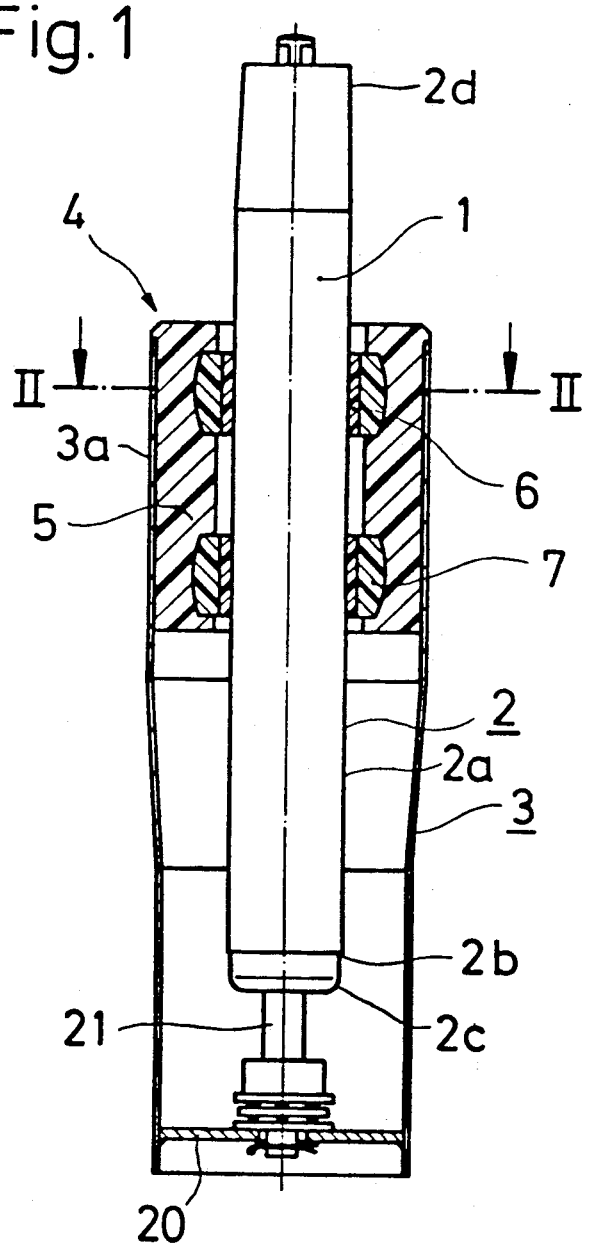
FIG. 1 shows a partial longitudinal section through a chair column of adjustable height.

According to FIG. 1, the chair column consists of a gas spring the downwardly emerging piston rod of which is made fast axially but arranged movably in the radial and circumferential direction in a bottom part 20 of a stand tube 3. The upper end portion 3*a* of the stand tube 3 is provided with a guide unit 4, which consists of a receiver bush 5, a bearing bush 6 and a radially elastic ring member 7 arranged therebetween. The cylindrical outer surface 2*a* of the gas spring cylinder 2 slides in the bearing bush 6 in height adjustment or inward spring movement of the gas spring 1. Here it is readily possible, as shown by the Figure, to arrange several bearing bushes 6, which are supported in the same way, in the receiver bush 5, axially one behind another. The piston rod 21 is releasably fixed to the bottom part 20 and has a radial play with respect to the bottom part 20.

Figure 2:
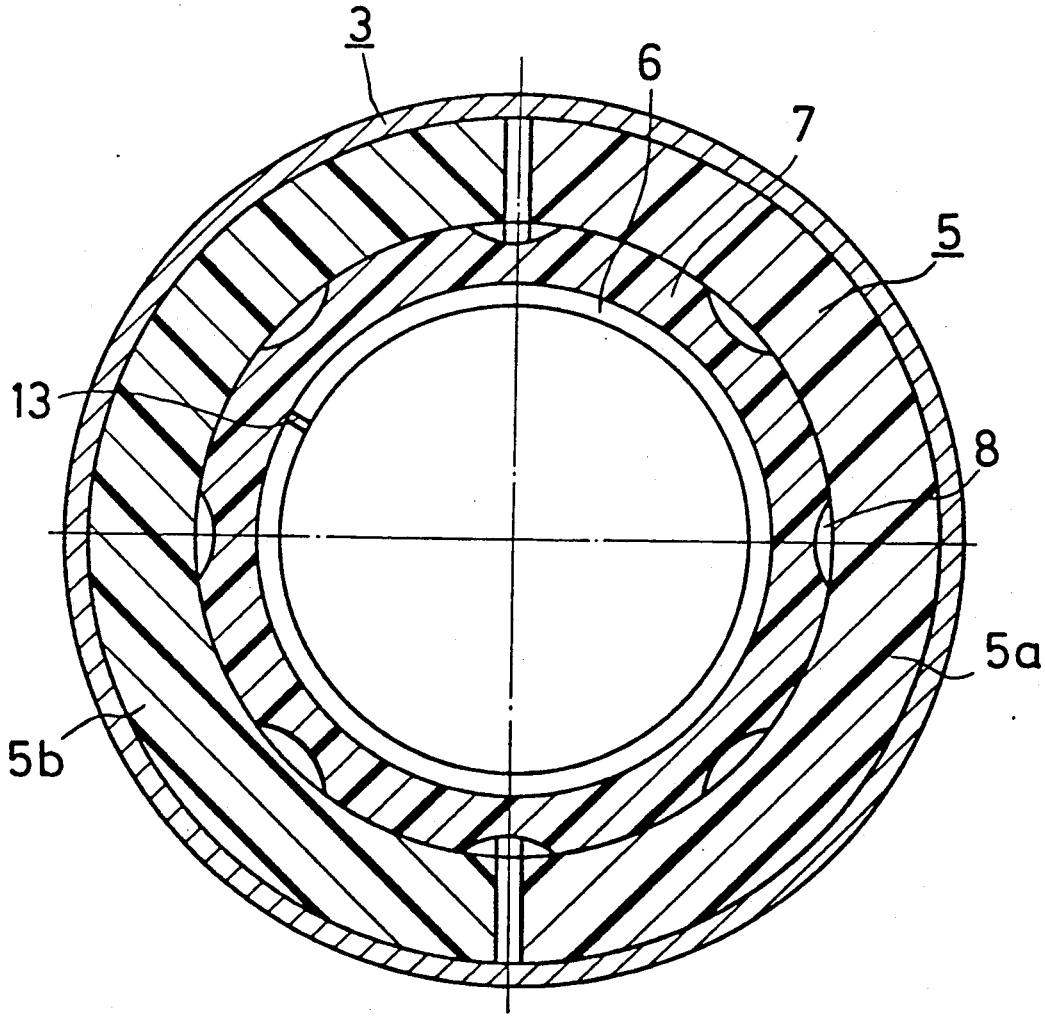
FIG. 2 shows a cross-section along the section line II—II in FIG. 1, in enlarged illustration.

According to FIG. 2, the receiver bush 5 comprises a number of recesses 8 arranged uniformly over the circumference in the region of the external diameter. Since according to FIG. 2 the gas spring 1 is not yet introduced into the bearing bushes 6, the ends of the bearing bushes collide in the region of the slot 13. The internal diameter formed by the bearing bush 6 is equal to or slightly smaller than the diameter of the cylindrical outer surface of the blockable gas spring. Advantageously, in this unstressed condition the internal diameter of the bearing bush 6 is 0.05 mm smaller than that of the cylindrical outer surface 2*a* of the gas spring cylinder 2. According to FIG. 2, the receiver bush 5 consists of two bush segments 5*a*, 5*b* into which the bearing bush 6 and the radially elastic ring member 7 are laid, before being pressed into the upper end portion 3*a* of the stand tube 3. Later, the gas spring cylinder 2 is inserted through the bearing bushes 6. The gas spring cylinder 2 is provided with tapered faces 2*b* and 2*c*, which facilitate passage of the gas spring cylinder 2 across the upper edges of the bearing bushes 6. The bearing bushes 6 are spread by the insertion of the gas spring cylinder 2, such that the radially elastic rings 7 are radially prestressed, and the bearing bushes 6 are prestressed against the cylindrical surface 2a.

Figure 3:
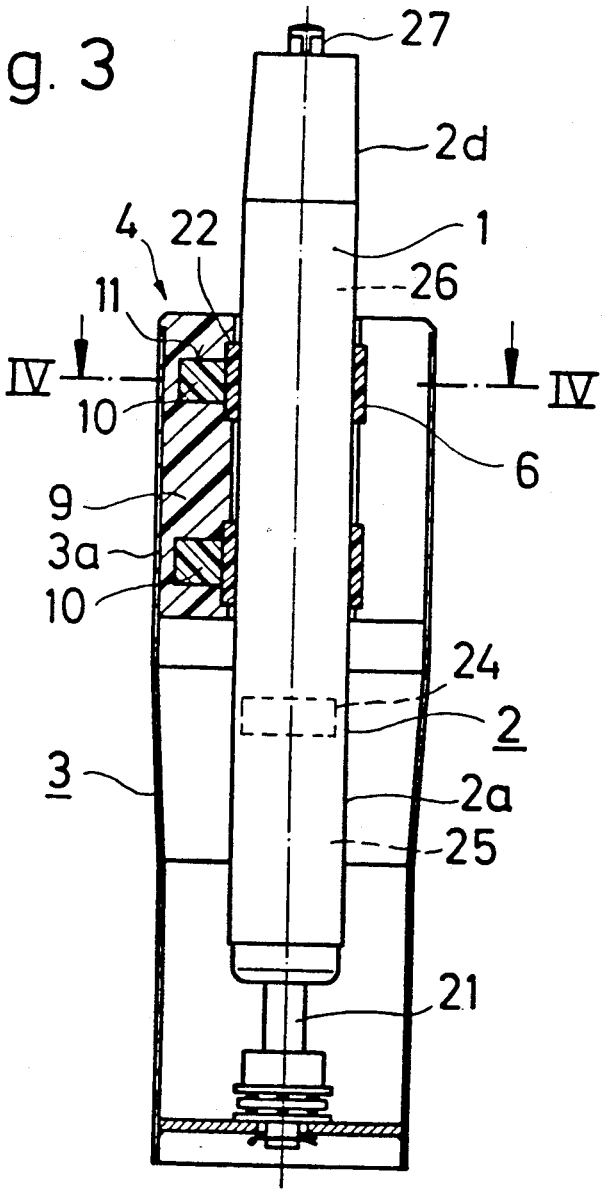
FIG. 3 shows a chair column in longitudinal section, which differs as regards the guide unit.
Figure 4:
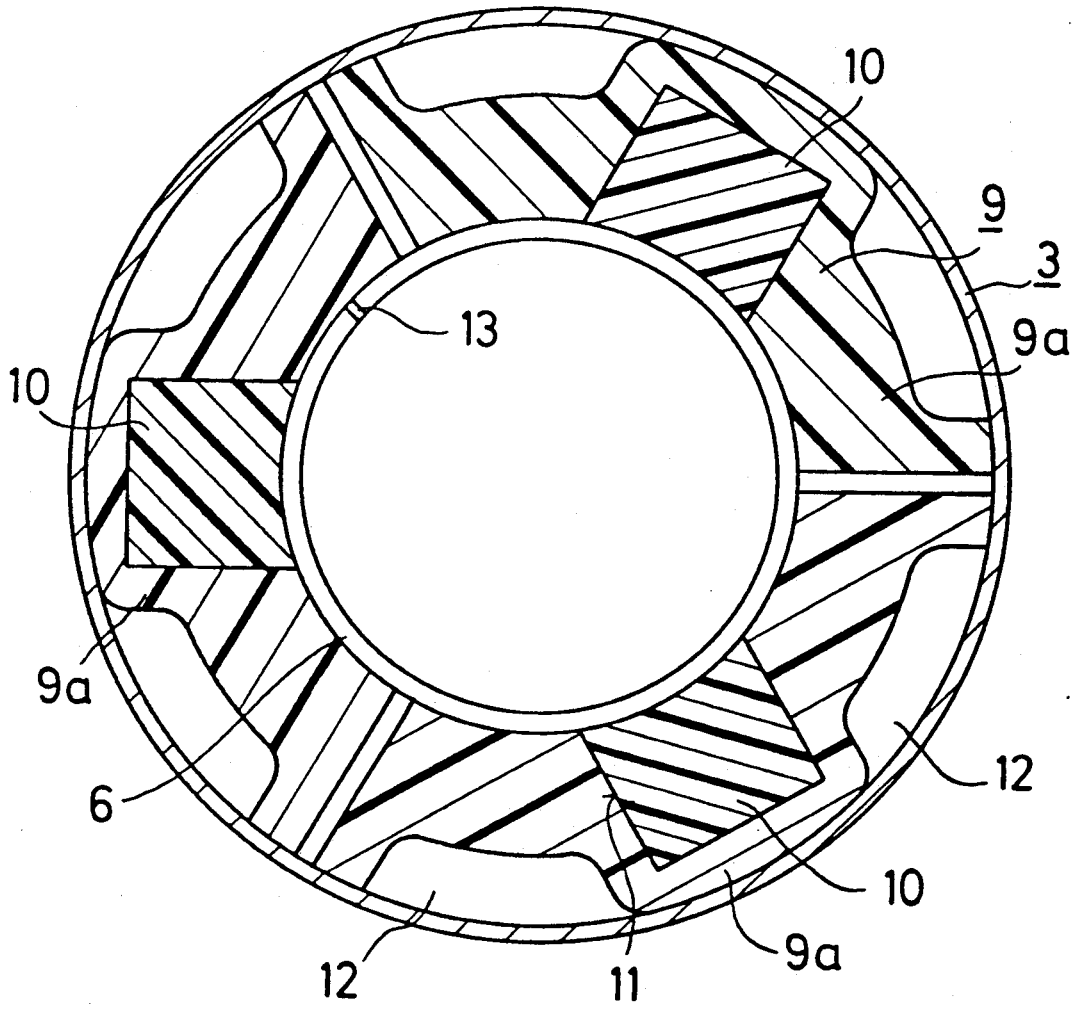
FIG. 4 shows a cross-section along the section line IV—IV in FIG. 3, in enlarged representation.

The form of embodiment as shown in FIGS. 3 and 4 differs from that according to FIGS. 1 and 2 essentially in that the guide unit 4 comprises a receiver bush 9 which is formed from three segments. These segments may be premounted by press button means (not shown). In this receiver bush 9 elastic buffers 10 in uniform distribution over the circumference are secured in appropriate cavities 11. These elastic buffers 10 consist either of rubber or synthetic plastic material foam and press against the bearing bush 6. For easier fitting of the guide unit in the upper portion 3a of the stand tube 3, recesses 12 are provided between the elastic buffers 10 in the receiver bush 9. Since in this form of embodiment too the internal diameter of the bearing bush 6 is chosen slightly smaller than the diameter of the cylindrical outer surface 2a of the gas spring cylinder 2, only after the pushing of the cylindrical outer surface 2a into the bearing bush 6 a gap is formed in the region of the slot 13. The elastic buffers 10 present in the receiver bush 9 act upon the bearing bush 6 with prestress. It is possible for this bearing bush 6 to be formed for example as a bearing bush of synthetic plastics material and then so deformed that the resultant diameter is smaller than the diameter of the cylindrical outer surface 2a.

On the other hand, in the case of higher transverse loadings of the chair column, it is advantageous if the bearing bush is manufactured from metal and has a coating of plain bearing material on the internal surface.

The lay-out of the elastic components is such that the prestress acting upon the bearing bush 6 under bending or transverse loadings produces no non-elastic deformation of the bearing bushes. On the other hand, the elastic buffers 10 generate a constant prestress of the bearing bushes 6 on the cylindrical outer surface 2a of the gas spring cylinder 2 and effect an absolute freedom from play in the region of the guide unit 4.

As can be seen from FIG. 3, the bearing bushes 6 are received by annular recesses 22 in the inner surface of the receiver bush segments 9a, and the bearing bushes 6 are axially fixed with respect to the receiver bush 9.

It is to be understood that due to the radial prestress between the bearing bushes 6 and the outer cylindrical surface 2a a certain friction exists between the bearing bushes 6 and the cylindrical surface 2a. This friction is minimized by a low friction coefficient of the radial inner surfaces of the bearing bushes 6. On the other hand, slight frictional forces against axial movement of the gas spring cylinder 2 is acceptable and even desirable for damping the movement of the gas spring cylinder 2.

The gas spring 1 is of conventional design. The piston rod 21 is combined with a piston 24 which separates two working chambers within the cylinder 2 from each other. The working chambers 25 and 26 are interconnectable through a valve unit, which may be opened by pushing down a control pin 27. As long as the valve unit is closed, a predetermined height of the gas spring 1 exists. When the valve unit is opened by pushing down the control member 27, the length of the gas spring 1 may be varied by gas exchange between the chambers 25 and 26. For downward movement of the gas spring cylinder 2, a downward directed axial force must be applied to the gas spring cylinder 2. Axial upward movement is obtained by the pressurized gas acting upon the cross-sectional area of the piston rod 21. The upper end of the gas spring cylinder 2 is provided with a tapered face 2d, on which a seat or table carrier may be fastened.

While a specific embodiment of the invention has been shown and described in detail to illustrate the application of the inventive principles, it will be understood that the invention may be embodied otherwise without departing from such principles.

The reference numerals in the claims are only used for facilitating the understanding and are by no means restrictive.

We claim:

1. A support column comprising a stand tube (3) having an axis, a bottom part (20) and an upper end portion (3a), a receiver bush (5) inserted into said upper end portion (3a), a telescopic positioning device (1) having a lower terminal portion (21) connected to said bottom part (20) of said stand tube (3) and a cylindrical member (2) extending through said receiver bush (5), said cylindrical member (2) having an outer cylindrical surface (2a) guided within said receiver bush (5) in substantially axial direction with respect to said stand tube (3), said outer cylindrical surface (2a) being in sliding engagement with at least one bearing bush (6), said bearing bush (6) being radially supported by said receiver bush (5), said bearing bush (6) being radially supported by said receiver bush (5) through radially elastic transmission means (7), said radially elastic transmission means (7) being radially prestressed, said at least one bearing bush (6) being radially prestressed against said outer cylindrical surface (2a) by the radial prestress of said transmission means (7).

2. A support column as set forth in claim 1, said bearing bush (6) being completely transversed by a substantially axially and radially extending slot (13).

3. A support column as set forth in claim 1, said radially elastic transmission means (7) comprising a radially elastic transmission ring (7).

4. A support column as set forth in claim 3, said radially elastic transmission ring (7) being coherent with said bearing bush (6).

5. A support column as set forth in claim 4, said radially elastic transmission ring (7) being coherent with said bearing bush (6) by two-layer-injection moulding.

6. A support column as set forth in claim 3, said radially elastic transmission ring (7) being at least partially received by a corresponding annular recess provided at a radially inner surface of said receiver bush (5).

7. A support column as set forth in claim 3, said radially elastic transmission ring (7) having a convex radially outer surface supported by a respective radially inner concave surface of said receiver bush (5).

8. A support column as set forth in claim 1, said radially elastic transmission means comprising a plurality of elastic buffer members (10) distributed around the axis.

9. A support column as set forth in claim 8, said buffer members (10) being at least partially received by respective cavities (11) within said receiver bush (9).

10. A support column as set forth in claim 8, said buffer members (10) being adherent to said receiver bush (9).

11. A support column as set forth in claim 1, said receiver bush (5, 9) being subdivided into a plurality of receiver bush segments (5a, 9a).

12. A support column as set forth in claim 11, said receiver bush segments (5a, 9a) being connected to each other by segment connection means.

13. A support column as set forth in claim 12, said segment connection means being press button type connection means.

14. A support column as set forth in claim 1, said receiver bush (5, 9) being provided with a plurality of recesses (12) in a radially outer surface thereof.

15. A support column as set forth in claim 1, said elastic transmission means (7) being made of an elastomeric material substantially softer in radial direction than the material of said receiver bush (5) and said bearing bush (6).

16. A support column as set forth in claim 15, said radially elastic transmission means (7) being made of one of a rubber elastic material and a foam plastic material.

17. A support column as set forth in claim 1, said receiver bush (5) being made of a synthetic plastic material.

18. A support column as set forth in claim 1, said bearing bush (6) being made of a synthetic plastic material.

19. A support column as set forth in claim 18, said bearing bush (6) being made of a graphite containing plastic material.

20. A support column as set forth in claim 1, said bearing bush (6) being made of a metal sheet material coated with a bearing surface layer.

21. A support column as set forth in claim 1, a plurality of bearing bushes (6) being provided along said axis.

22. A support column as set forth in claim 21, two bearing bushes (6) being provided axially one behind the other.

23. A support column as set forth in claim 21, each of said bearing bushes (6) being combined with separate radially elastic transmission means (7) allocated thereto.

24. A support column as set forth in claim 1, said lower terminal portion (21) of said telescopic positioning device (1) having a radial play with respect to said bottom part (20) of said stand tube (3).

25. A support column as set forth in claim 1, said telescopic positioning device (1) being a cylinderpiston rod device having at least one cylinder member (2) and a piston rod (21), said piston rod (21) being connected to said bottom part (20) of said stand tube (3), said cylinder member (2) providing said outer cylindrical surface (2a).

26. A support column as set forth in claim 1, said stand tube (3) being adapted for being connected with a foot structure, said cylindrical member (2) being adapted for being connected with a load member, such as a seat plate or a table plate.

* * * * *